United States Patent [19]

Ingenhoven

[11] Patent Number: 4,669,283

[45] Date of Patent: Jun. 2, 1987

[54] CENTRAL LOCKING DEVICE FOR AUTOMOBILE DOORS

[75] Inventor: Jürgen Ingenhoven, Velbert, Fed. Rep. of Germany

[73] Assignee: Kiekert GmbH & Co. Kommanditgesellschaft, Heiligenhaus, Fed. Rep. of Germany

[21] Appl. No.: 783,484

[22] Filed: Oct. 3, 1985

[30] Foreign Application Priority Data

Nov. 28, 1984 [DE] Fed. Rep. of Germany ..... 3443287

[51] Int. Cl.[4] ..... E05B 65/36

[52] U.S. Cl. ..... 70/264; 70/280; 74/89.15; 74/424.8 R; 74/584; 292/144; 292/201; 292/DIG. 23; 292/DIG. 25; 403/22; 403/118

[58] Field of Search ..... 292/201, 144, DIG. 3, 292/DIG. 14, DIG. 23, DIG. 25, 336.3; 74/89.15, 470, 584, 625, 424.8 R; 403/22, 21, 118; 70/262–264, 280, 237, 283, 256, 257; 192/150, 56 R, 94; 464/30; 318/10, 15

[56] References Cited

U.S. PATENT DOCUMENTS

| | | | |
|---|---|---|---|
| 2,516,642 | 7/1950 | Murphy | 74/584 |
| 2,704,947 | 3/1955 | Hopkins | 74/625 |
| 2,979,965 | 4/1961 | Diebold | 74/424.8 R |
| 3,710,632 | 1/1973 | Tucker | 74/89.15 |
| 4,050,319 | 9/1977 | Stanley | 74/424.8 R X |
| 4,135,377 | 1/1979 | Kleefeldt et al. | 70/280 X |
| 4,250,762 | 2/1981 | Weatherby | 74/89.15 |
| 4,342,209 | 8/1982 | Kleefeldt | 70/264 |
| 4,354,396 | 10/1982 | Charles | 74/89.15 X |
| 4,364,249 | 12/1982 | Kleefeldt | 292/201 X |

FOREIGN PATENT DOCUMENTS

| | | | |
|---|---|---|---|
| 2013773 | 8/1979 | United Kingdom | 70/264 |
| 2144796 | 3/1985 | United Kingdom | 292/336.3 |

*Primary Examiner*—Robert L. Wolfe
*Assistant Examiner*—Lloyd A. Gall
*Attorney, Agent, or Firm*—Karl F. Ross; Herbert Dubno

[57] ABSTRACT

An electrically operable device for actuating vehicle doors and the like from a central panel location is disclosed, especially for doors having an individual lock, and having electromechanical actuation including an actuating rod adapted to be reciprocatingly displaced, as well as being adapted to assume an unlocked position, a locked position, and an antitheft position. The actuating rod is further adapted to operate the respective control rod operatively connected to the respective door lock. The device includes a reversible electric motor, a transmission, and an actuating mechanism for the drive rod. The device also includes exterior ridges on a spindle-nut and projecting formations which can be overridden, upon completion of the locking stroke, as well as on completion of the unlocking stroke, as well as for carrying out of an antitheft stroke. The device also includes a spindle which is positioned parallel to the up-and-down movement of the actuating rod, and which is provided with a self-retarding thread and on which is guided the spindle-nut which on respective sides is provided with the exterior ridges. The actuating rod is formed of two fork-like arms which extend on both sides of the spindle and each arm has a resiliently deflectable projecting formation. The lower ends of the arms are joined by a traverse or stop, onto which can be placed, at the end of the antitheft stroke, the spindle-nut.

11 Claims, 5 Drawing Figures

CENTRAL LOCKING DEVICE FOR AUTOMOBILE DOORS

CROSS REFERENCE TO RELATED APPLICATION

This application is related to the concurrently filed copending application Ser. No. 783,486 based upon German Patent document No. 34 43 288 filed Nov. 28, 1984.

FIELD OF THE INVENTION

My present invention relates to a device for locking and unlocking of doors, trunk lids, hoods, or other closures of vehicles, such as passenger cars, trucks and the like, and more particularly, to devices which are electrically actuated from a master panel.

BACKGROUND OF THE INVENTION

The centrally actuated devices of this type, i.e. devices which can be controlled from a central or master panel, generally cooperate with the mechanical lock mechanism at each door. The device typically includes an electromechanical drive means for each such door lock mechanism. On actuation, the drive means imparts the desired actuating motion, e.g. locking and unlocking. This is achieved by way of a vertically movable actuating rod which is operatively connected to a control rod associated with the door lock mechanism. The actuating rod, furthermore, is capable of moving between an unlocked position and a locked position, as well as being capable of assuming an antitheft position.

The drive or actuator means can comprise an electromechanical system and can include a reversible electric motor and a transmission which imparts the desired function to the actuating rod.

The device also includes an operating means with an actuator, as well as coupling formations or "noses" in the form of ridges, and coupling counternoses in the form of projecting formations. These are arranged to be capable of, on the one hand, moving the actuating rod for the lock stroke and for the unlock stroke. They are also capable to override one another, upon completion of the lock stroke, as well as upon completion of the unlock stroke.

The coupling noses and/or the coupling counternoses are correspondingly elastically formed or journaled so that the overriding can occur.

In a known locking device, as described in German Pat. No. 29 11 630, the transmission cooperates with the actuator or piston by way of an output gear, and the actuator includes a corresponding rack formation. The actuator or piston moves parallel with respect to the separate actuating rod or bar.

The arrangement of the several components is such that the coupling noses, or similar projections or formations, of the actuator engage the actuating rod.

Accordingly, the actuator is formed with a resiliently mounted and swingably movable coupling nose, or similar formation. In this arrangement, the coupling nose of the actuating rod can be engaged and taken along by the formations of the actuator, as well as being capable of being overridden by it.

Similar measures are taken for the additional antitheft control system.

This system has generally been found to be acceptable and has been proven in use although in many ways it is cumbersome and awkward to manufacture and assemble.

OBJECTS OF THE INVENTION

It is, accordingly, the principal object of my present invention to improve upon the central locking device of the type briefly discussed in the foregoing in such a way that the device can be more economically produced and assembled than heretofore, but without affecting its proper functioning.

It is further an object of the present invention to enhance the operation of the device in such a way that its functioning is more easily carried out.

It is also an object of the invention to provide a central locking device with a reduced number of components.

My invention also has the object of improving upon antitheft properties of the locking unit which is capable of central control.

It is yet another object of the invention to provide a central locking device which is of sufficient stability.

SUMMARY OF THE INVENTION

These objects are attained in accordance with the invention in that the transmission acts upon a spindle which is parallel to the vertically reciprocating actuating rod. The spindle is provided with an external self-blocking screw-type thread precluding unintentional, irreversible functioning. A spindle-nut or similar element is mounted on the spindle, and can move along on the spindle, i.e. up or down depending upon the sense of rotation of the spindle. The nut has coupling noses in the form of projections or ridges.

The device also includes an actuator or actuator means having two arms arranged in bifurcate manner and also performing the function of the actuating rod or shaft. Respectively one arm extends on a respective side of the spindle. Each arm is formed with a coupling counternose in the form of a projecting formation. Respective ends of the arms are joined to form a transverse base or similar base member which serve as the seat or stop for the spindle-nut at the completion of the antitheft stroke.

The invention is based on the observation that in the transmission of the central locking device of the type described herein, one of the gear wheels can be replaced by a spindle, or an additional spindle can be provided. This provides the opportunity that a special element which is formed as a piston need not be used because the actuating rod per se can provide the function of the piston when it is decided, or resolved as it were, into two arms presenting a bifurcate appearance as described.

This affords a considerable simplification as far as the production is concerned and particularly the assembly is highly simplified, whereas the kinematic of the cooperating elements, and the functioning, particularly the assured functioning of the system, are not detrimentally affected.

In accordance with one preferred embodiment of the invention which is preferred due to its overall compactness of design and high stability of the electromechanical actuation or drive, the spindle, the spindle-nut, and the two arms of the actuating rod are disposed in a common plane.

It is also preferred that the spindle-nut and the exterior ridges thereof are formed as functionally inelastic components and are made, for example, of metal or a plastic/synthetic-resin material.

A further highly simple embodiment is attained when the two arms of the actuating rod, and/or the coupling counter-noses, are at least in part made of a material having elastic or resilient properties.

In accordance with yet another embodiment, it is also preferred that the two arms of the actuating rod form, having regard to static considerations, a frame or a box. This will serve to attain a sufficient stability and rigidity for all arising demands.

BRIEF DESCRIPTION OF THE DRAWING

The above and other objects, features and advantages will become more readily apparent from the following description, reference being made to the accompanying drawing in which.

SPECIFIC DESCRIPTION

Figure 1:
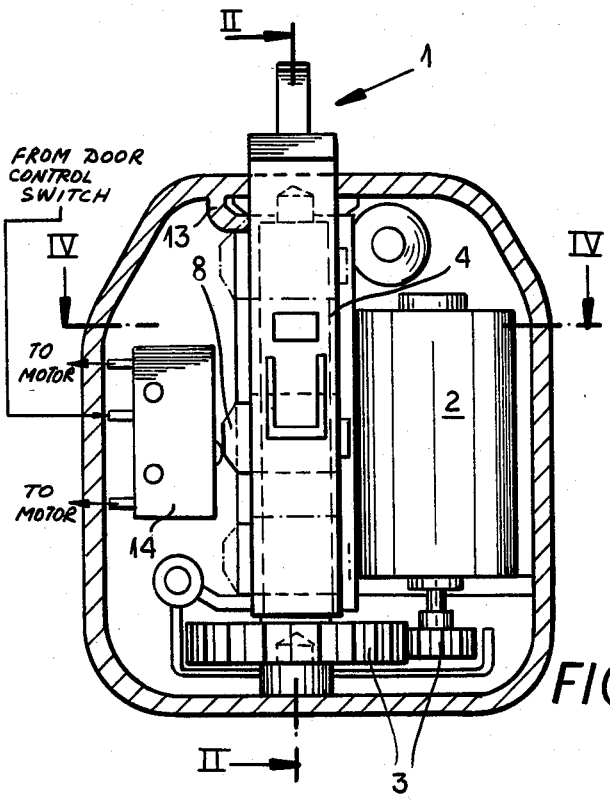
FIG. 1 is a side elevation of an electromechanical drive for the central locking device shown in part in cross section.

The drawing shows an embodiment of the electromechanical drive or actuator assembly intended for use with the mechanical door lock in an electrical central locking device for vehicle doors and the like. The electromechanical drive acts on a control rod of the associated door lock.

Figure 4:
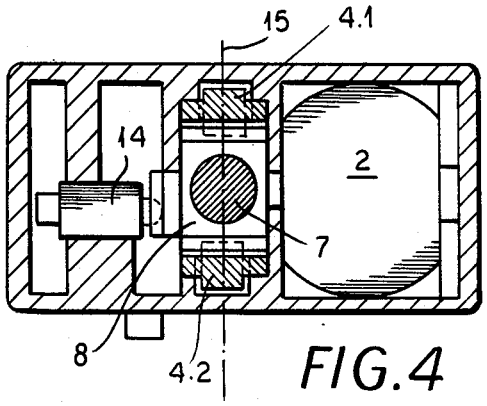
FIG. 4 is a cross section along line IV—IV in FIG. 1.
Figure 5:
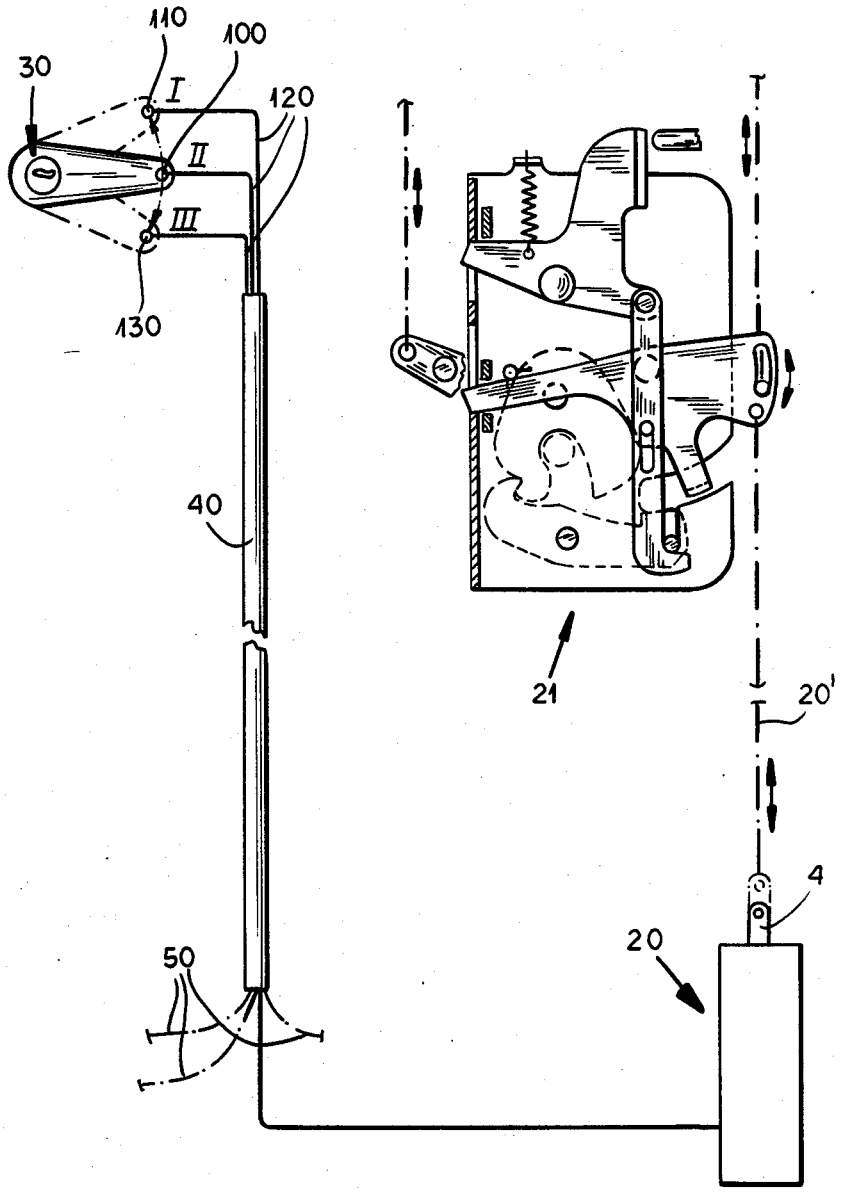
FIG. 5 is a diagram of a central locking system having the arrangement of FIGS. 1–4 at each door lock.

As will be apparent from FIG. 5, the device of FIGS. 1–4 can constitute the actuator 20 whose actuator member is coupled as represented by the dot-dash line 20' to the door lock.

The device is particularly applicable in a centrally operable actuating system wherein the actuator 20 is linked to a mechanical door lock 21. The system is operated by a switch 30 which is connected to an unlock control 110, a lock control 100, and an antitheft control 130. The system may branch to other doors by means of branch lines 50. The electrical wiring is generally identified by reference numeral 40. (For additional details see German patent DE-PS No. 29 11 630).

Figure 2:
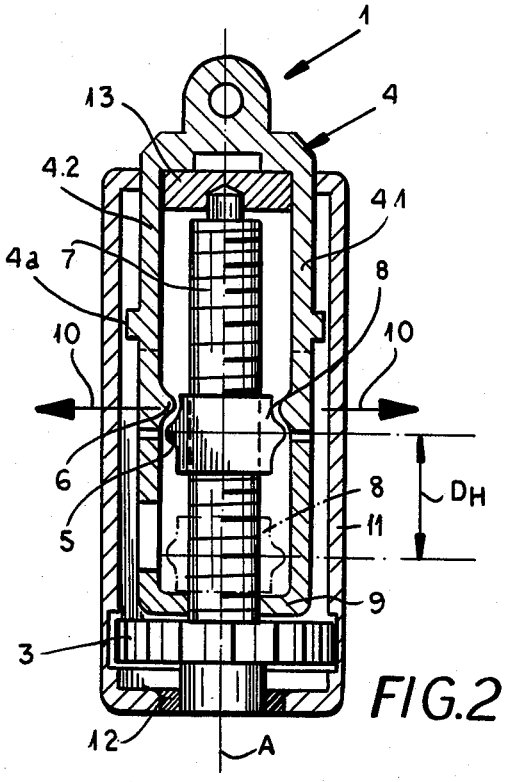
FIG. 2 is a cross section along line II—II in FIG. 1.
Figure 3:
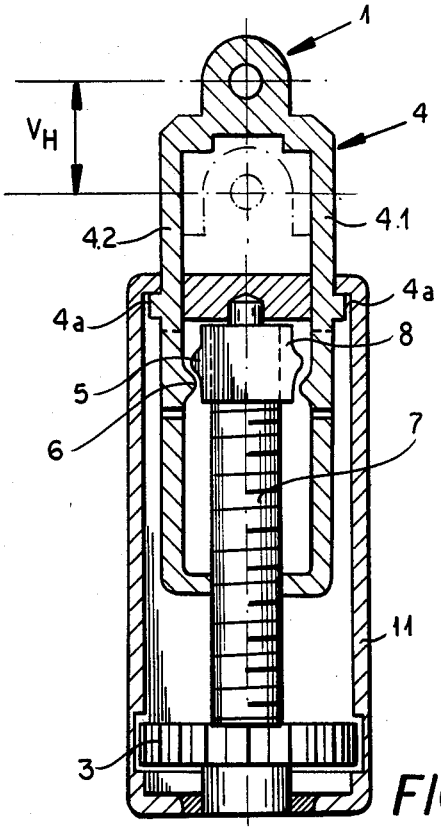
FIG. 3 is a cross section similar to FIG. 2, but showing a further operating condition.

The device includes a drive or actuating rod 1 which can move in vertically reciprocating manner, at least between an unlocked position (rod retracted—FIG. 2) and a locked position (rod extended—FIG. 3).

The device generally includes a reversible electric motor 2, a transmission 3, and means for controlling movement of the actuating rod 1. Thus, the device is equipped with an actuator member generally identified by reference numeral 4, as well as coupling noses in the form of ridges or projections 5. It also includes coupling counternoses in the form of projecting formations 6. The ridges 5 and projecting formations 6 interact in such a way that the actuating rod 1 is taken along or moved during the lock stroke $V_H$, as well as during the unlock stroke or movement. In addition, at completion of the lock stroke $V_H$, as well as after the unlock stroke, each projecting formation 6 can override the associated ridge 5 as the projection 6 is deflected outwardly resiliently.

As is particularly evident from FIG. 1, the transmission 3 is connected with its output side or gear to a centrally disposed spindle 7. Furthermore, the spindle 7 is positioned parallel or in line with the axis A (FIG. 2) of the actuating rod 1. The actuating rod 1 is mounted in the housing 11 in such a way that it is capable of carrying out an up-and-down movement, i.e. the actuating rod 1 is capable of carrying out reciprocating motions or movements in vertical directions (compare FIGS. 1, 2 and 3). The spindle 7 is a rod formed at its upper end with an external helical screw-thread whose pitch renders it self-blocking or precluding rotation of the spindle by the application of axial force to the nut.

A spindle-nut 8, or similar element is cooperatingly mounted on the spindle 7, i.e. threadedly engages the threaded portion thereof, and this spindle-nut 8 can be moved along on and by the spindle 7, i.e. up or down in conformity with the rotation or turning of the spindle 7. The spindle-nut 8 is mounted in such a way that it does move up or down, as indicated in FIGS. 2 and 3, at least through a distance equal to $V_H$, but rotation thereof is precluded. The spindle-nut 8 can be of rectangular configuration when viewed in plan, see FIG. 4, and it is fashioned on each of the two shorter sides with exterior ridges such as projecting ridges or the like formations 5, see FIGS. 2 and 3.

The actuator 4 is a bifurcate element with parallel arms 4.1 and 4.2 which are joined to generally perform the function of the actuating rod 1. The arms 4.1 and 4.2 are joined at their lowermost ends to form a transverse base or similar base member 9.

The arms 4.1 and 4.2 embrace between them the centrally disposed spindle 7, and each arm has an inwardly projecting nose or similar projecting formation 6 which respectively cooperates with the adjacent associated ridge 5 at the spindle-nut 8.

As can best be seen in FIG. 4, the spindle 7, the spindle-nut 8, and the arms 4.1 and 4.2 are disposed in a common plane (indicated by axis line 15).

The spindle-nut 8 and its exterior ridges 5 are formed as functionally inelastic components, i.e. these components are made of a corresponding material with generally high rigidity. Plastic/synthetic resin materials having the respective strength and stability can be used. In contrast, the two arms 4.1 and 4.2 of the drive shaft 1 are at least in part made of a material having properties which allow elastic or resilient movement or displacement, particularly of the projecting formations 6 of the arms 4.1 and 4.2.

Accordingly, at completion of the upward stroke, i.e. the lock-stroke $V_H$, the ridges 5 override the projecting formations 6, whereby the ridges 5 deflect the formations 6 in the outward directions indicated by the arrows 10 (FIG. 2).

The upwardly directed movement of the actuating rod 1, i.e. of the arms 4.1 and 4.2 is limited by the external projections **4*a* on the arms 4.1 and 4.2 which will contact the top of the housing 11** when the fully locked position has been reached.

When comparing the respective positions of the movable components in FIG. 2, showing the unlocked condition of the locking device, and in FIG. 3, showing the locked condition of the device, it will be clear that the actuating rod 1 can be moved from the retracted position, corresponding to the unlocking or releasing condition of the device, into the extended position corresponding to the locking condition of the device. Accordingly, in conformity with the selected condition, upon corresponding electrical control signal output, the movement of spindle-nut 8 and electrical motor 2 ceases due to the microswitch or limit switch 14 which has only been diagrammatically represented in FIG. 1.

Of course movement of the actuating rod 1 can be reversed whereby it retracts from the extended position into the withdrawn position, thereby allowing unlocking of the device.

The actuating rod 1 is moved in conformity with the locking stroke or distance $V_H$ as well as the unlocking stroke (reverse movement), with the formations 5 overriding the projections 6 at the arms 4.1 and 4.2 at the respective end points of each stroke or lift.

The embodiment shows that the actuating rod 1, i.e. the arms 4.1 and 4.2 thereof, form a frame or box-like structure having corresponding static properties, rigidity, and stability.

The antitheft stroke $D_H$ is evident in FIGS. 1 and 2. Thus, the spindle-nut 8 is at rest or stopped at the transverse member 9 at completion of the antitheft stroke or lift. Accordingly, the lock stroke and unlock stroke will only be possible when the spindle nut 8 has been returned to the intermediate position, i.e. the position shown in solid lines in FIG. 2.

The projecting formations 6 are arranged on a generally rectangular base when viewed in the side elevation according to FIG. 1. In order to accommodate their being overridden by the ridges 5 and to allow a resilient deflecting movement or displacement, the arms 4.1 and 4.2 are cut in a U-shape fashion.

The lower end of the spindle 7 is journaled in a bushing or the like 12 at the bottom wall of the housing 11, and the upper end of the spindle 7 is correspondingly mounted by means of a holder arm 13 near the upper wall of the housing 11.

I claim:

1. A device for electrically actuating vehicle door locks from a central location wherein each individual lock has electromechanical actuating means for actuating at least a control rod operatively connected to the respective door lock, said device comprising:

a reversible electric motor having an output;

a transmission operatively connected to said output of said reversible electric motor;

an actuating mechanism for operating each of said locks comprising:

an actuating member connected to said control rod and formed with two spaced-apart parallel arms, a self locking threaded spindle received between said arms, and a spindle-nut threaded on said spindle, said nut and each arm having a projecting mutually engaging formation and said arms being joined at the respective ends to form a traverse against which, at completion of an antitheft stroke of said spindle-nut the traverse of the actuating member is abutted by said spindle-nut, said antitheft stroke causing said spindle nut to override the projecting formation of said two arms, said arms and the respective projecting formations thereon being constructed of a sufficiently elastic material to resiliently allow the respective formations on said spindle-nut to cam said formations of said arms outwardly.

2. The device defined in claim 1 wherein said spindle, said spindle-nut, and said arms are disposed in one plane.

3. The device defined in claim 1 wherein said formations on said spindle-nut and said spindle-nut are substantially inelastic components.

4. The device defined in claim 1 wherein said arms and said traverse form a frame.

5. The device defined in claim 1 wherein said arms are disposed in a box-like pattern.

6. The device defined in claim 1 wherein said two arms are disposed in bifurcate manner when viewed in cross section.

7. The device defined in claim 1 wherein said actuating member assumes a position corresponding to the unlocked condition, a position corresponding to the locked condition, and a position corresponding to an antitheft condition of the lock, and is adapted to actuate the control rod of the lock.

8. The device defined in claim 1 wherein said spindle-nut is equipped at each of two opposite sides with at least one ridge forming the respective formation.

9. The device defined in claim 1 wherein said transmission includes meshing gear wheels.

10. An actuator, especially for locking and unlocking vehicle doors from a central location, said actuator comprising:

a housing;

a reversible electric motor mounted in said housing and having an output;

a transmission arranged in said housing and operatively connectable to said output of said reversible electric motor;

an output member driven by said transmission, said output member being adapted to selectively assume a lock position, an unlock position, and an antitheft position, in conformity with the input from said reversible motor, said output member comprising an actuating rod formed by two arms extending in spaced relation with respect to one another with each arm having at least one projecting formation of resilient elastic material, whereby said formations extend in opposed relation with respect to one another, said arms being joined at the respective ends thereof to form a traverse stop;

a spindle between said arms, said spindle having an end formed with an effective length of a helical screw with a screw-thread which is substantially self-locking and precluding unintentional movement; and a spindle-nut movably mounted on said spindle on said screw-thread, said spindle-nut having ridges which are dimensioned and positioned to carry along said actuating rod during the lock stroke and during the unlock stroke thereof by engaging said projecting formations of said actuating rod, and being adapted to carry out an antitheft stroke as well as being capable of, upon completion of a respective lock stroke and upon completion of a respective unlock stroke and, for carrying out a respective antitheft stroke, overriding said projecting formation of said at least two arms.

11. In an electrical central locking device for a door of a vehicle having an actuating rod mounted for vertical reciprocating movement with an unlocked position, a locked position, and an antitheft position, and adapted to operate a control rod of an associated door lock, said device including:

a reversible electric motor, a transmission, and an actuating mechanism for the actuating rod, which is equipped with an actuator as well as coupling noses and coupling counternoses which are adapted to carry along the actuating rod during a respective lock stroke and during a respective unlock stroke, and wherein upon completion of the respective lock stroke, as well as upon completion of the respective unlock stroke, and for effecting a respective antitheft stroke, the coupling counternoses are overridden by said coupling noses, the improvement which comprises:

a spindle operatively connectable to said transmission, and positioned substantially parallel with respect to said actuating rod, said spindle having at least one end formed with a self-retarding thread; and a spindle-nut guide on said spindle, said spindle-nut on at least two sides being provided with projecting formations;

and two arms formed on said rod and extending on opposite sides of said spindle, with each arm carrying at least one coupling counternose of resilient elastic material, said two arms being joined in the form of a base to allow seating thereon of said spindle-nut at the completion of an antitheft stroke.

* * * * *